US012240568B2

(12) United States Patent
Steevens et al.

(10) Patent No.: US 12,240,568 B2
(45) Date of Patent: Mar. 4, 2025

(54) SURFBOARD TOTING DEVICE

(71) Applicants: Madelaine Steevens, San Diego, CA (US); Lee Geisinger, San Diego, CA (US)

(72) Inventors: Madelaine Steevens, San Diego, CA (US); Lee Geisinger, San Diego, CA (US)

( * ) Notice: Subject to any disclaimer, the term of this patent is extended or adjusted under 35 U.S.C. 154(b) by 237 days.

(21) Appl. No.: 17/965,643

(22) Filed: Oct. 13, 2022

(65) Prior Publication Data

US 2023/0182870 A1 Jun. 15, 2023

Related U.S. Application Data

(60) Provisional application No. 63/255,584, filed on Oct. 14, 2021.

(51) Int. Cl.
*A45F 3/14* (2006.01)
*B63B 32/87* (2020.01)

(52) U.S. Cl.
CPC ..... *B63B 32/87* (2020.02); *A45F 3/14* (2013.01); *A45F 2003/142* (2013.01)

(58) Field of Classification Search
CPC .... B63B 32/87; A45F 3/15; A45F 3/14; A45F 2003/142; A45F 3/02; A45F 2003/003
See application file for complete search history.

(56) References Cited

U.S. PATENT DOCUMENTS 3,377,007 A * 4/1968 Gayler, Jr. ..... B63B 32/87 294/157
4,044,415 A * 8/1977 Wood ..... B63B 32/73 441/75
4,911,347 A * 3/1990 Wilhite ..... A45F 3/14 224/264
5,437,401 A * 8/1995 Seltzer ..... A45F 3/14 294/149
5,695,101 A * 12/1997 Frietze ..... A45F 3/14 224/257

* cited by examiner

*Primary Examiner* — Adam J Waggenspack
(74) *Attorney, Agent, or Firm* — Timothy W Fitzwilliam

(57) ABSTRACT

A surfboard accessory toting device is disclosed herein for carrying a surfboard. The device is specifically designed to distribute load evenly to its most reinforced areas. Materials are chosen and a hook-and-loop type securing system are also designed for security and longevity. Critical areas of the device are further double-stitched and lengths of fabric are folded and sewn together also for this purpose.

6 Claims, 4 Drawing Sheets

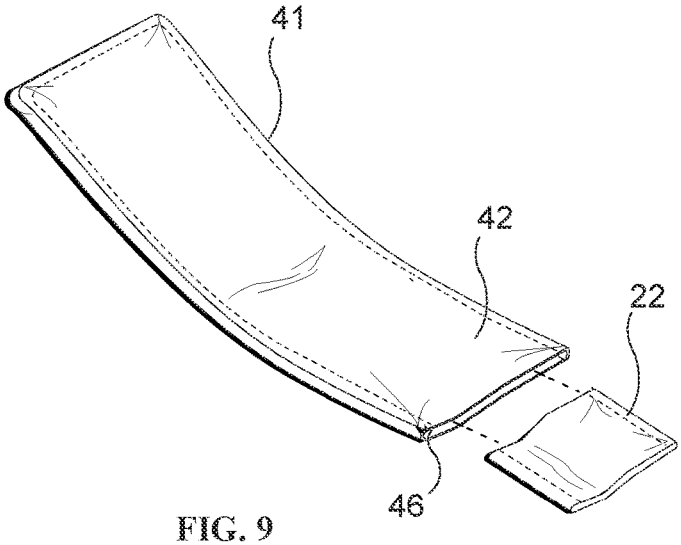
FIG. 9
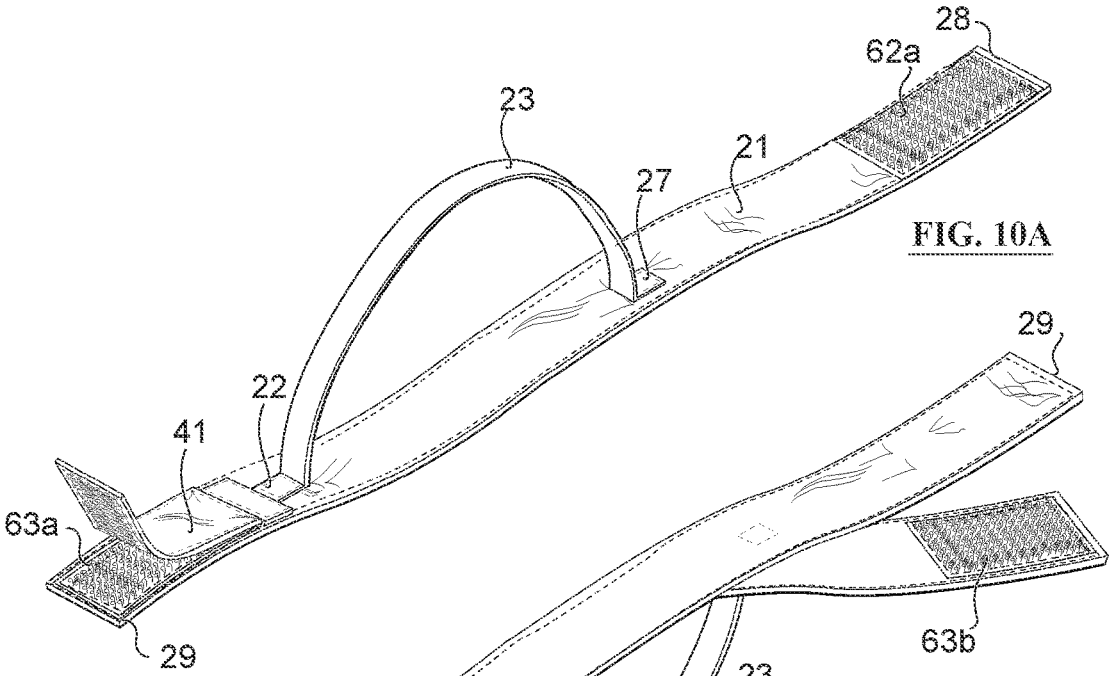
FIG. 10A
FIG. 10B

SURFBOARD TOTING DEVICE

PRIORITY CLAIM

This patent application claims benefit of the priority date of U.S. Prov. Pat. App. Ser. No. 63/255,584 filed on Nov. 14, 2021 entitled "Surfboard Toting Device." Accordingly, the entire contents this U.S. provisional patent submission is hereby expressly incorporated by reference.

BACKGROUND OF THE INVENTION

Field of the Invention

The present invention pertains generally to strapped toting devices and accessories for boardsports. More specifically, the present invention relates to board carriers assisting ambulatory transport. Particularly, in a preferred embodiment, the invention is useful a sling-type carrier for a surfboard.

Description of the Prior Art

In recent decades, surfing has gained considerable attention as an exhilarating form of outdoor exercise in a natural environment. Furthermore, surfing goes hand-in-hand with other beach going activities where family and friends may spend an entire day at the beach. Also, importantly, beach goers may have to walk down (a subsequently back up) a steep hill or through woods, etc., from their vehicle or hotel/residence to the beach. Or, wave hunters may have to walk a considerable distance up or down a beach for better surf.

Hence there is a need for a coinvent surf carrier having a shoulder strap, which may, colloquially, be termed a surf purse or surf satchel. The proposed invention would be greatly useful especially where additional gear such as; wetsuits, towels, coolers, umbrellas, beach chairs, soccer/volleyball etc., are in need of transport in addition to the surfboard. It is still further an object of the present invention to provide a design that evenly distributes loads with reinforced material to provide strength and longevity to the design.

BRIEF SUMMARY OF THE INVENTION

The present invention specifically addresses and alleviates the above-mentioned deficiencies, more specifically, the present invention, in first aspect is a surfboard toting device comprising: a surfboard to be transported; a first and a second strap device the first and second strap device configured about a midsection around a width of surfboard; a first strap loop configured to the first strap device and a second strap loop configured the second strap device; and a shoulder strap for fitting over a user's shoulder, the shoulder strap configured to the first strap loop and the second strap loop, the shoulder strap together with the first and second strap loop, and together with the first and the second strap device thereby supporting a weight of the surfboard for transport.

The invention in this aspect is additionally characterized in that the first strap device comprises: a long strap having a proximal and a distal end configured around the width of the surfboard; a sandwiching short strap configured offset from the distal end, wherein the proximal end is configured around and fitting between the distal end and the sandwiching short strap.

Further in the first aspect, the long strap further comprises: a lengthwise fold along an edge being positioned at the edge in a method of manufacturing a long strap; a first seam around a border of the long strap except not around the edge at the lengthwise fold and except at a space provided to turn the long strap inside-out; a second seam around an entire of the border, thereby the border being double stitched except for the edge at the lengthwise fold and the space provided to turn the long strap inside-out that are instead single stitched.

Yet still the invention is characterized in that the sandwiching short strap further comprises: a lengthwise fold along an edge in a method of manufacturing a sandwiching short strap; a first seam around a border of the long strap except not around the edge at the lengthwise fold and except at a space provided to turn the sandwiching short strap inside-out; a second seam around an entire of the border except for the space provided to turn the sandwiching short strap inside-out, thereby the border being double stitched except for the edge at the lengthwise fold that is single stitched, and the space provided to turn the sandwiching short strap inside-out that is instead open.

Yet still further in the first aspect, the invention may be characterized wherein an end of the first strap loop is configured to fit inside of the space provided to turn the sandwiching short strap inside-out and sewn affixed thereto. Also, the a first and a second loop-type fasteners sections are provided, wherein the first loop-type fasteners section is configured on the long strap proximal end and the second loop type fasteners section is configured on the long strap proximal end opposite side. Corresponding are a first and a second hook-type fasteners sections, wherein the first hook-type fasteners section is configured on the long strap distal end and the second hook-type fasteners section is configured on a the sandwiching short strap, wherein the first and second loop-type fasteners sections and the first and second hook-type fasteners sections together thereby form a hook-and-loop type fastening system for the long strap.

Additionally, the shoulder strap further comprises: a first end sewn to itself forming a loop configured through the first strap loop; an opposite second end configured to itself forming a loop via a triglide having the shoulder strap and the opposite second end therethrough; and a shoulder pad, the shoulder pad comprising rubber encased by a textile fabric skin.

The invention in the first aspect is additionally characterized in that the first strap device comprises denim, or cotton canvas or polyester canvas, or nylon canvas, or an outdoor fabric blend, or sail cover canvas, or recycled canvas. Also herein the triglide is rigid, the triglide further comprises plastic, or aluminum, or recycled aluminum, or bamboo.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 9 is yet an additional perspective view of the short strap mating to a shoulder strap coupling loop and a related method of making;

FIG. 10A is an enlarged perspective view of a long strap of the device laid out flat; and FIG. 10B is an additional enlarged perspective view of a long strap of the device laid out flat, however upside down showing sandwiching hook and loops fasteners.

DETAILED DESCRIPTION OF PREFERRED EMBODIMENTS

Figure 1:
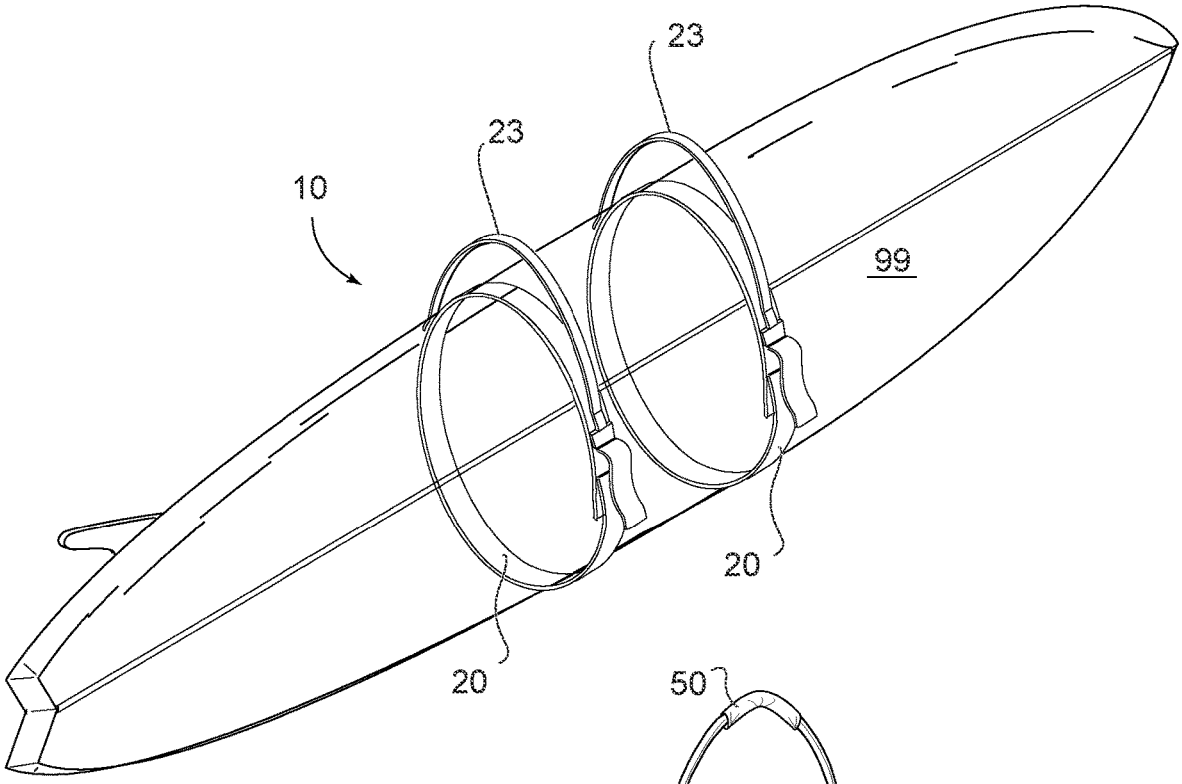
FIG. 1 is an elevational view of the invention secured to a surfboard.

Referring initially to FIG. 1, a surfboard toting device 10 is shown generally with the securing portion configured to a board 99 for ambulatory transport. The securing portion contains first and second strap devices 20 spaced apart for even load distribution. In turn, strap loops 23 are provided coupled to the strap devices 20 to create a chain for coupling to a shoulder strap 30 as shown in FIG. 2.

Figure 3:
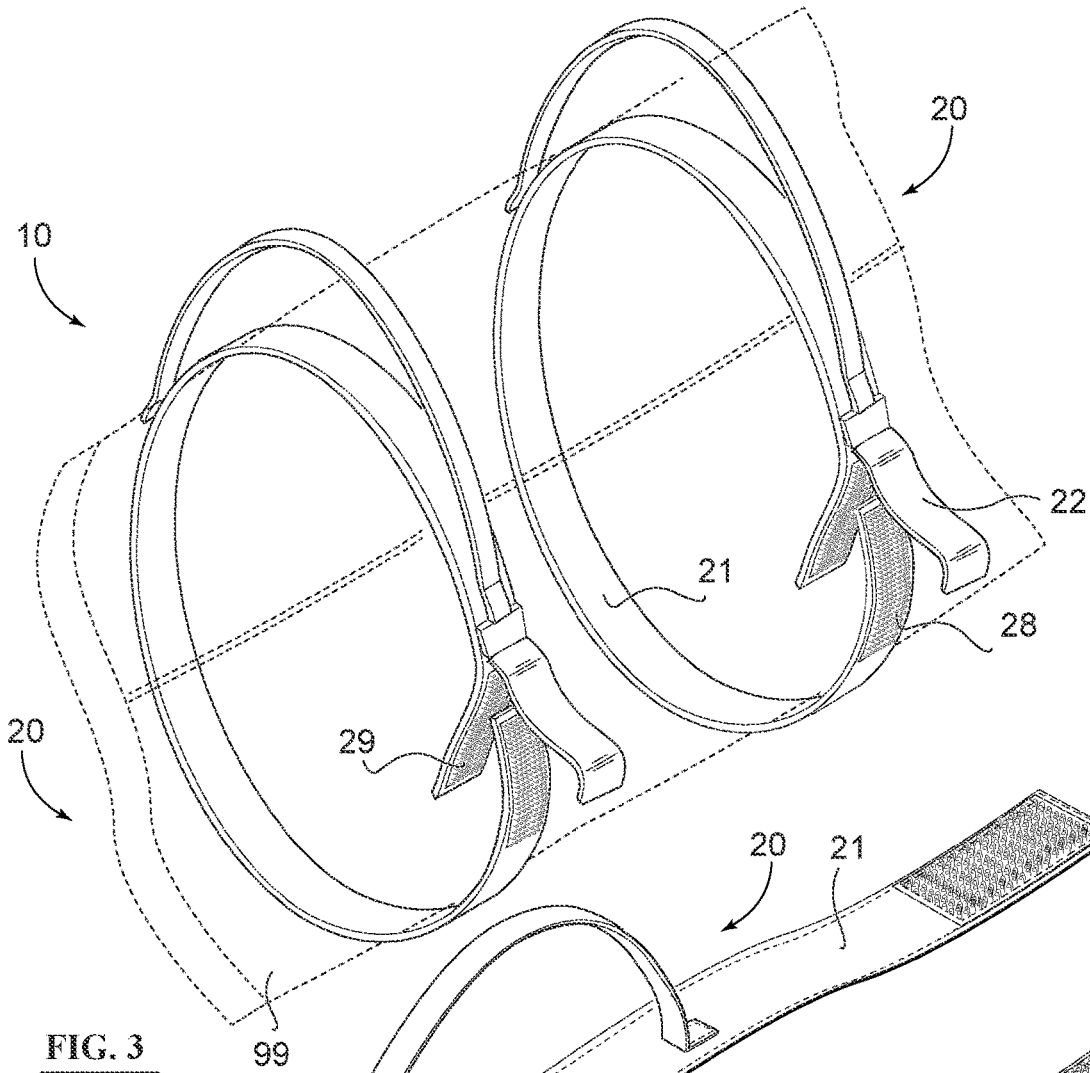
FIG. 3 is an additional enlarged view of the securing portion that holds a surfboard of the present invention.

With regard to FIG. 3, an enlarged view of the securing section of the surfboard 99 is shown from an elevational viewpoint. The strap device 20 principally comprise the baseline long strap 21. Ends 28, 29 of the long strap 21 are securely fastened with a hook and loop fastening system 62*a*, 62*b*, 63*a*, 63*b* as detailed herein, commonly known as Velcro®. In a preferred embodiment, the long strap 21 is a 3½ to 4½ wide inch piece of durable woven fabric, measuring 53 to 57 inches long, going around a surfboard 99 along its width and overlapping between 7 and 10 inches as needed for the sandwiching hook and loop fastening system, as detailed herein. More particularly loops 63*a*, 63*b*, sandwich loops 62*a*, 62*b*. The overlap allows for at least 7 inches of Velcro® to firmly hold the surfboard 99 in place. An additional 3 inches provides adjustment and tightness depending on the width and thickness of the surfboard 99 being transported. The invention 10 dimensions are based on standard surfboard 99 width ranging from 19 inches to 23 inches.

Figure 2:
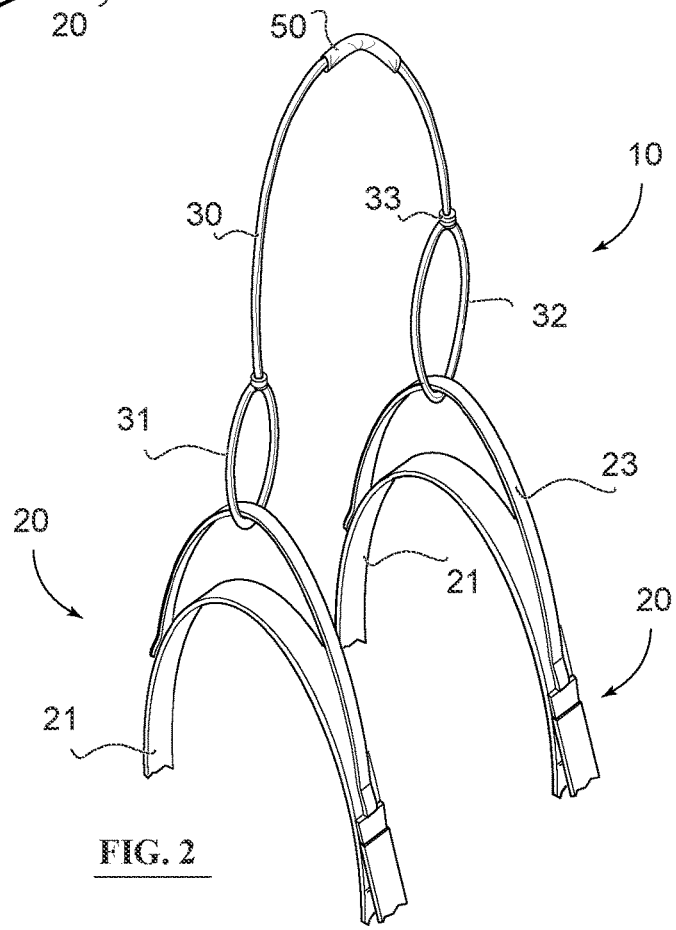
FIG. 2 is an enlarged view thereof with attention to a shoulder strap portion.

With regard to FIG. 1 together with FIG. 2, a surfboard toting device 10 comprises: a surfboard 99 to be transported; and a first 20 and a second 20 strap device each configured about a midsection and around a width of surfboard. Further, a first strap loop 23 is configured to the first strap device 20 and a second strap loop 23 is configured the second strap device 20. A shoulder strap 30 for fitting over a user's shoulder is provided, the shoulder strap configured to the first strap loop 20 and the second strap loop 20, the shoulder strap 30 together with the first and second strap loop 23, and together with the first and the second strap device 20 thereby supporting a weight of the surfboard 99 for transport.

Figure 4:
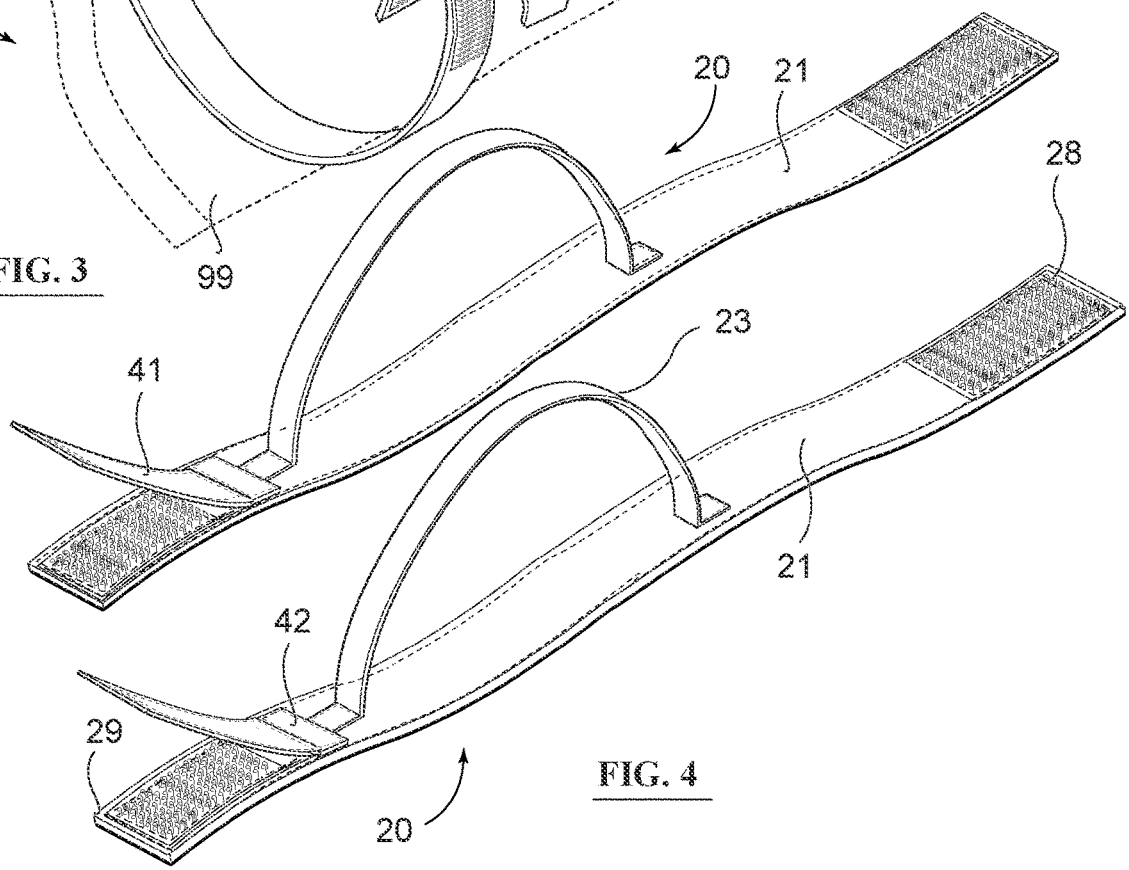
FIG. 4 is a perspective view of the securing portion as seen from a laid out flat position.

With reference to FIG. 3 together with FIG. 4, each long strap 21 has a distal 29 and proximal 28 end that form the hook and loop fastening system that tightly secures the two ends 28, 29 of the long strap 21. A first end (e.g. distal 29) of the long strap is configured with an upper piece 41 of fabric sandwiching a second end 28 of the long strap 21, alternatively referred to as a sandwiching short strap 41 herein. The upper piece sandwiching short strap 41 is 12½ to 13½ inches long in the preferred embodiment. Strap loops 23 are coupled to the long strap 21 approximately at it's center as illustrated in FIG. 4. The strap loop 23 is a 2½ inch to 2¾-inch-wide tube of fabric measuring between about 18 inches to 20 inches. It is constructed as a tube further thereby being two-ply providing additional tensile strength as further detailed herein in this component as well as others.

In the preferred embodiment, the surfboard toting device 10 strap devices 20 each comprise new denim or warn/recycled denim material. In other embodiments, the strap devices 20 are made of material chosen from the group consisting of: cotton canvas polyester canvas, nylon canvas, outdoor fabric blends, sail cover canvas, or recycled canvas. Threads 25, 45 are chosen to be strong for longevity and may be a higher gauge than typical threads. Examples are upholstery and outdoor thread.

Figure 5:
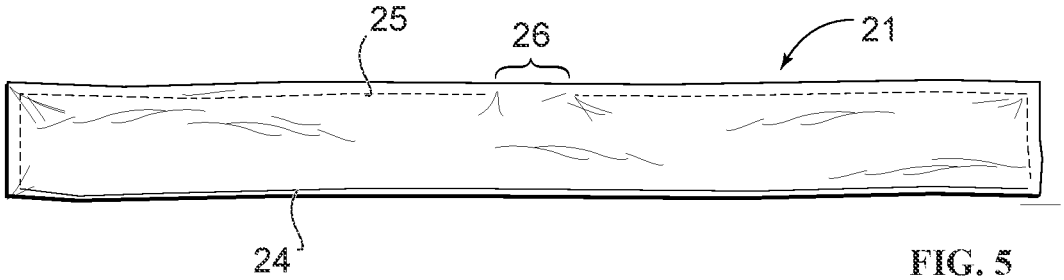
FIG. 5 is a top view original, elongated piece of fabric illustrative of a method of making a surfboard toting device of the present invention.
Figure 6:
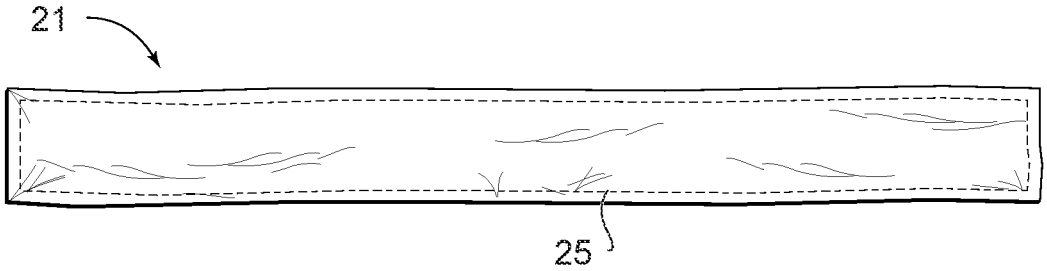
FIG. 6 is a similar top plan view following a method step of turning the original piece inside out.

Now with regard to FIG. 5 and FIG. 6, the invention is additionally a method of making a surfboard toting device 10 long 21 and short 41 straps, comprising the following method steps. First, obtain a precut elongated strip of fabric 21, folding 24 it about its lengthwise axis as to make a taco, albeit an elongated one. Next, is the step of stitching 25 the folded 24 strap 21 about three open sides except for open area 26 and turning the long strap 21 inside-out (or now right-side-out, FIG. 6) about open area 26. Next, the fabric (long strap 21) is stitched 25 around its full border, yet again, for stability and strength. It should be noted that the long strap 21 is now two-ply due to the method step of folding 24. Open area 26 is chosen long enough at a mid-section of the long strap 21 to pull the now folded 24 and sewed 25 strap 21 inside out. It should be appreciated that long strap 21 is initially laid out and stitched inside-out and then turned right-side-out and stitched reinforced again.

It should be appreciated regarding FIG. 5 and FIG. 6, that the long strap further comprises: a lengthwise fold 24 along an edge being positioned at the edge in a method of manufacturing a long strap (FIG. 5 and FIG. 6); a first seam 25 around a border of the long strap except not around the edge at the lengthwise fold and except at a space provided 26 to turn the long strap inside-out; a second seam 25 (now illustrated in FIG. 6) around an entire of the border, thereby the border being double stitched except for the edge 24 at the lengthwise fold and the space 26 provided to turn the long strap inside-out that are instead single stitched.

Figure 7:
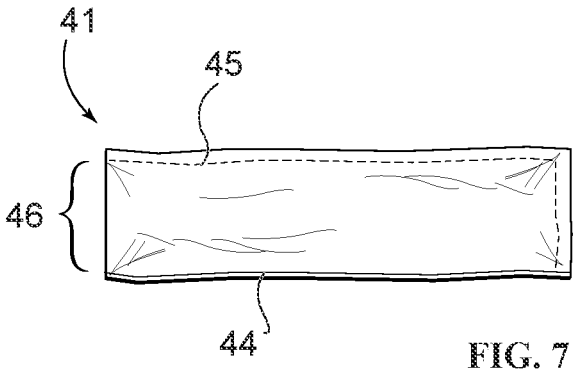
FIG. 7 is a top plan view of a shorter sandwiching strap and a method of making same.
Figure 8:
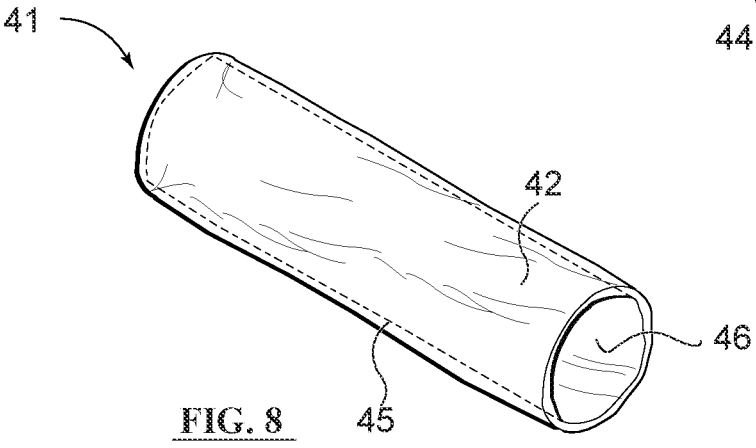
FIG. 8 is a similar top plan view of the short sandwiching strap.

Further, the method of making long and short straps 21, 41 of the present invention is characterized wherein the sandwiching short strap 41 is made as shown in FIG. 7 and in FIG. 8. Similar to the long strap 21, the short strap 41 is folded 44 about its lengthwise axis, and then stitched 25 on two sides leaving an open area 46 on a third side. Next, the fabric is turned inside out (or right-side out) about the open area 41 and is reinforced stitched 45 again about 3 sides, leaving the open area 46 open for insertion of strap loop 23 according to FIG. 9. Therein an end 22 of strap loop 23 is slid into a mouth 46 of short strap 41 and a small box on short strap end 42 is stitched to secure same. Then, an additional external stitch is made around the entire border of short strap 41. Also importantly, the short strap 41 is also a decorative strap providing a pleasing contrast (FIG. 10A) between solid fabric and decorative fabric. The long 21 and short 41 straps, simply put, are two-ply (and double stitched 25, 45) by folding 24, 44, sewing 25, 45, turning inside out (FIG. 6 and FIG. 8), and sewing 25, 45 again.

It should be appreciated regarding FIG. 7 and FIG. 8, the sandwiching short strap further comprises: a lengthwise fold 44 along an edge in a method of manufacturing a sandwiching short strap; a first seam 45 around a border of the long strap except not around the edge 44 at the lengthwise fold and except at a space 46 provided to turn the long strap inside-out; a second seam 45 (now seam 45 in FIG. 8) around an entire of the border except for the space 46 provided to turn the sandwiching short strap 41 inside-out, thereby the border being double stitched except for the edge at the lengthwise fold 44 that is single stitched, and the space 46 provided to turn the sandwiching short strap inside-out that is instead open 46.

Regarding FIG. 10A, FIG. 10B together with FIG. 3, the invention is notable for its strength and longevity of design. The strap devices 20 are placed with a four-inch gap between the long straps 21 chosen to evenly distribute the weight of the surfboard. This allows the sandwiching short strap 41 and the long strap 21 to meet toward the top of the board 99 and prevent load bearing directly on the Velcro®, but rather on the double stitched reinforced areas 22, 42.

Also with reference to FIG. 10A together with FIG. 2, the strap loop 23 attaches to long strap 2*v* and daisy chains with shoulder strap 30. Opposite end 22 of strap loop 23 is attached by double stitching end 22 at a two-inch interval. Also as shown in FIG. 2, shoulder strap 30 is folded and double stitched similar to long strap 21 and sandwiching short strap 41. Next, chain loops are formed and shoulder strap 30 first end 31 is sewn (to itself forming a loop) to shoulder strap 30. Then, should pad 50 is positioned in place and subsequently, opposite second end 32 goes through the adjuster triglide 33 and similarly sewn to shoulder strap 30 to allow same to be adjustable. The triglide 33 is rigid and chosen from the material group consisting of: plastic, aluminum recycled aluminum, or bamboo. Further, shoulder pad 30 is comprised of recycled neoprene rubber with a piece of decorative fabric being sewn (or glued) over it. In other words, the should pad 50 is rubber with fabric skin about and surrounding the rubber interior.

Additionally regarding FIG. 10A, the surfboard toting device 10 comprises first and second long straps 21, with a single of the pair 21 of straps shown in the perspective view. The long strap 21 comprises proximal 28 and distal 29 ends with the proximal end comprising loop-type 62*a*, 62*b* Velcro® material sewn its top (FIG. 10A) and bottom (FIG. 10B) sides. The distal end (FIG. 10A) comprises hook-type Velcro® material on a topside thereof, but not on the bottom (FIG. 10B). The sandwiching short strap 41 (which may also be a decorative strap, for example yellow hibiscus pattern) comprises hook-type Velcro® material 63*b* on an underside (FIG. 10B) thereof, and thereby wherein the strap securing system 21, 41, 62*a*, 62*b*, 63*a*, 63*b* sandwiches the proximal end 28 with two sets of Velcro®. The placement of the Velcro® on the straps 21, 41 are in the middle so that there is about a ½ inch border around the edge of the Velcro®.

While the particular Surfboard Toting Device herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A surfboard toting device comprising:

a surfboard to be transported;

a first and a second strap device, the first and second strap device wrapped around a width of the surfboard approximately at a midsection thereof;

a first strap loop attached to the first strap device and a second strap loop attached the second strap device;

a shoulder strap for fitting over a user's shoulder, the shoulder strap connected to the first strap loop and the second strap loop, the shoulder strap together with the first and second strap loop, and together with the first and the second strap device thereby supporting a weight of the surfboard for transport; and wherein the first strap device comprising:

a long strap having a proximal and a distal end arranged around the width of the surfboard; and a sandwiching short strap configured offset from the distal end, wherein the proximal end is arranged around and fitting sandwiched between the distal end and the sandwiching short strap; and wherein the long strap further comprising:

a lengthwise fold along an edge being positioned at the edge in a method of manufacturing a long strap;

a first seam around a border of the long strap except not around the edge at the lengthwise fold and except not at a space provided to turn the long strap inside-out; and a second seam around an entirety of the border, thereby the border being double stitched except for the edge at the lengthwise fold and the space provided to turn the long strap inside-out that are both instead single stitched.

2. The surfboard toting device of claim 1, the sandwiching short strap further comprising:

a lengthwise fold along an edge in a method of manufacturing a sandwiching short strap;

a first seam around a border of the sandwiching short strap except not around the edge at the lengthwise fold and except not at a space provided to turn the sandwiching short strap inside-out;

a second seam around an entirety of the border except for the space provided to turn the sandwiching short strap inside-out, thereby the border being double stitched except for the edge at the lengthwise fold that is single stitched, and the space provided to turn the sandwiching short strap inside-out that is instead open.

3. The surfboard toting device of claim 2 wherein an end of the first strap loop is arranged to fit inside of the space provided to turn the sandwiching short strap inside-out and sewn affixed thereto.

4. The surfboard toting device of claim 1, further comprising:

a first and a second loop-type fasteners sections, wherein the first loop-type fasteners section is configured on the long strap proximal end and the second loop type fasteners section is configured on the long strap proximal end opposite side;

a first and a second hook-type fasteners sections, wherein the first hook-type fasteners section is configured on the long strap distal end and the second hook-type fasteners section is configured on the sandwiching short strap, wherein the first and second loop-type fasteners sections and the first and second hook-type fasteners sections together thereby form a hook-and-loop type fastening system for the long strap.

5. A surfboard toting device comprising:

a surfboard to be transported;

a first and a second strap device, the first and second strap device wrapped around a width of the surfboard approximately at a midsection thereof;

a first strap loop attached to the first strap device and a second strap loop attached the second strap device;

a shoulder strap for fitting over a user's shoulder, the shoulder strap connected to the first strap loop and the second strap loop, the shoulder strap together with the first and second strap loop, and together with the first and the second strap device thereby supporting a weight of the surfboard for transport; and wherein the first strap device further comprising:

a long strap having a proximal and a distal end configured around the width of the surfboard; and a sandwiching short strap configured offset from the distal end, wherein the proximal end is placed around and fitting sandwiched between the distal end and the sandwiching short strap; and wherein the sandwiching short strap further comprising:

a lengthwise fold along an edge in a method of manufacturing a sandwiching short strap;

a first seam around a border of the sandwiching short strap except not around the edge at the lengthwise fold and except not at a space provided to turn the sandwiching short strap inside-out; and a second seam around an entirety of the border except for the space provided to turn the sandwiching short strap inside-out, thereby the border being double stitched except for the edge at the lengthwise fold that is single stitched, and the space provided to turn the sandwiching short strap inside-out that is instead open.

6. The surfboard toting device of claim 5 wherein an end of the first strap loop is arranged to fit inside of the space provided to turn the sandwiching short strap inside-out and sewn affixed thereto.

* * * * *